US009559458B2

(12) United States Patent
Zhang et al.

(10) Patent No.: US 9,559,458 B2
(45) Date of Patent: Jan. 31, 2017

(54) QUICK SELF-LOCKING THREAD COUPLING INTERFACE CONNECTOR MECHANISM

(71) Applicant: CommScope Technologies LLC, Hickory, NC (US)

(72) Inventors: Yujun Zhang, Jiangsu Suzhou (CN); Jianping Wu, Jiangsu Zhenjiang (CN); Huifang Zhou, Jiangsu Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/384,234

(22) PCT Filed: Mar. 1, 2013

(86) PCT No.: PCT/US2013/028576

§ 371 (c)(1),
(2) Date: Sep. 10, 2014

(87) PCT Pub. No.: WO2013/148063

PCT Pub. Date: Oct. 3, 2013

(65) Prior Publication Data

US 2015/0064957 A1 Mar. 5, 2015

(30) Foreign Application Priority Data

Mar. 26, 2012 (CN) ..... 2012 1 0082879

(51) Int. Cl.
*H01R 13/62* (2006.01)
*H01R 13/623* (2006.01)
(Continued)

(52) U.S. Cl.
CPC ..... *H01R 13/623* (2013.01); *H01R 13/6275* (2013.01); *H01R 13/6277* (2013.01); *H01R 13/5219* (2013.01); *H01R 24/40* (2013.01)

(58) Field of Classification Search
CPC ..... H01R 13/6275; H01R 13/6277; H01R 13/5219; H01R 24/40; H01R 13/623
(Continued)

(56) References Cited

U.S. PATENT DOCUMENTS 4,941,846 A 7/1990 Guimond et al.
5,192,219 A * 3/1993 Fowler ..... H01R 13/622 285/92
(Continued)

FOREIGN PATENT DOCUMENTS

CN 1885638 12/2006
WO WO 9306635 A1 * 4/1993 ..... H01R 13/622

OTHER PUBLICATIONS

Sung Gon Kim, International Search Report for corresponding application PCT/US13/28576, Jun. 17, 2013, Daejeon Metropolitan City, Republic of Korea.
(Continued)

*Primary Examiner* — Tulsidas C Patel
*Assistant Examiner* — Peter G Leigh
(74) *Attorney, Agent, or Firm* — Myers Bigel P.A.

(57) ABSTRACT

A quick self-locking thread coupling connector interface with an inner contact inside the insulator, the insulator inside the outer contact, the coupling nut has at least one convex tooth and a first protruding part on the inner side, the elastic claw has slots corresponding to the convex teeth, a second protruding part and thread are provided on the outer side and the inner side of the elastic claw. The outer contact and the cable connector body are connected fixedly, the elastic claw surrounds rotatably outside the outer contact and is limited axially at the left end by the outer contact. The push nut surrounds the cable connector body and is limited axially, the elastic component is located between the elastic claw, the push nut, and props against the elastic claw and the push nut.
(Continued)

The coupling nut surrounds the elastic claw and is connected fixedly with the push nut.

7 Claims, 3 Drawing Sheets

(51) Int. Cl.
*H01R 13/627* (2006.01)
*H01R 13/52* (2006.01)
*H01R 24/40* (2011.01)

(58) Field of Classification Search
USPC ..... 439/362, 352, 255, 253, 584
See application file for complete search history.

(56) References Cited

U.S. PATENT DOCUMENTS 5,456,611 A * 10/1995 Henry ..... H01R 13/6395 439/180
5,564,942 A * 10/1996 Lee ..... H01R 9/0521 439/462
5,595,499 A 1/1997 Zander et al.
6,024,609 A * 2/2000 Kooiman ..... H01R 24/40 411/433
6,217,384 B1 * 4/2001 Strasser ..... H01R 24/564 439/578
6,749,454 B2 * 6/2004 Schmidt ..... H01R 13/6277 439/350
7,070,447 B1 * 7/2006 Montena ..... 439/578
7,281,947 B2 10/2007 Pescatore
7,300,309 B2 * 11/2007 Montena ..... H01R 9/0524 439/578
7,455,550 B1 * 11/2008 Sykes ..... 439/584
7,568,934 B1 * 8/2009 Williams et al. ..... 439/271
7,785,129 B2 * 8/2010 Chen ..... H01R 13/5202 439/271
7,850,472 B2 * 12/2010 Friedrich et al. ..... 439/256
7,972,158 B2 * 7/2011 Wild ..... H01R 13/6277 439/257
8,167,647 B1 * 5/2012 Lee ..... 439/578
2003/0156900 A1 8/2003 Vaitkus et al.
2009/0264003 A1 * 10/2009 Hertzler et al. ..... 439/299
2009/0305560 A1 12/2009 Chen
2010/0105235 A1 4/2010 Friedrich et al.
2011/0165789 A1 * 7/2011 Sykes ..... 439/352
2011/0294329 A1 * 12/2011 Sasaki ..... H01R 13/625 439/320
2012/0064768 A1 * 3/2012 Islam et al. ..... 439/585
2013/0157508 A1 * 6/2013 Blasick ..... 439/583

OTHER PUBLICATIONS

Bertrand Philippot, European Search Report for associated case EP13767995.7, Oct. 5, 2015, European Patent Office, The Hague.

* cited by examiner

QUICK SELF-LOCKING THREAD COUPLING INTERFACE CONNECTOR MECHANISM

FIELD OF TECHNOLOGY

The present invention relates to the field of cable connection, especially to the field of coaxial cable connection, in particular to a quick self-locking thread coupling interface connector mechanism, which can apply to various common connector types, such as SMA, TNC, and N etc.

DESCRIPTION OF RELATED ARTS

In current telecommunication markets, thread-coupling mechanism is so quite popular and used to lots of applications, for example, to connect two coaxial cables, a male connector and a female connector are connected to a coaxial cable respectively, and then the thread connecting end of the female connector is connected threadedly with the thread connecting end of the male connector.

The thread-coupling mechanism distinguishes itself from its high mechanical strength, high durability, and high reliability. Meanwhile, its disadvantages are also quite obvious. One must take certain time to make a good connection to happen, for it is too much trouble to match the threads of the male and female connectors, which must take a certain amount of time to align, after matching the threads of the male and female connectors, the male and female connectors can be rotated to be tightened, otherwise, it is not easy for the male and female connectors to be screwed on or causes damage to their threads, moreover it usually have to rotate for several circles to tighten the threads of the male and female connectors, so as to achieve a stable connection, thus the installation and removal both are very cumbersome, and not convenient to use; furthermore, in some occasion where space is quite limited, for it must take a certain amount of time to match the threads of the male and female connectors and have to rotate for several circles to tighten them, the installation and the removal both are very cumbersome, thus it is not convenient to use thread coupling connectors.

To address the above issues, a SNAP-N interface has been developed in the market, but it requires a special female connector to achieve the connection, and because it adopts the positioning of clamping jaws entering into slots and the N-type contact end positioning, the positioning belongs to the secondary over positioning, at the same time, it loses the characteristics of high reliability and high tightness of the thread connection due to the cancellation of the thread of the male connector, thus the characteristics of high-frequency performance and reliability of the connector decrease slightly. Meanwhile it requires a special female connector to achieve the connection, making its application scope small, its promotion more difficult, and its use cost increased.

Therefore, there is a need to provide a connector mechanism, which maintains the merits of the traditional coupling mechanism, applies to the thread connecting ends of the existing female connectors, and has the characteristics of connecting quickly and easily, broad application scope, easy promotion and low use cost.

SUMMARY OF THE INVENTION

Aspects of the present invention generally pertain to a quick self-locking thread coupling interface connector mechanism, which is designed skillfully, has a concise structure, maintains the merits of the traditional coupling mechanism, applies to the thread connecting ends of the existing female connectors, and has the characteristics of connecting quickly and easily, broad application scope, easy to promote and low use cost, therefore the present invention is suitable for large-scale popularization.

In order to realize the above aims, in a first aspect of the present invention, a quick self-locking thread coupling interface connector mechanism is provided, and comprises an inner contact, an insulator and an outer contact, the inner contact is inside the insulator, the insulator is inside the outer contact, the quick self-locking thread coupling interface connector mechanism further comprises an elastic claw, a cable connector body, an elastic component, a coupling nut and a push nut, the coupling nut has at least one convex tooth and a first protruding part on the inner side, the elastic claw has declining slots whose number is same to that of the convex teeth, a second protruding part and thread are provided on the outer side and the inner side of the elastic claw respectively, the outer contact and the cable connector body are connected fixedly, the elastic claw surrounds rotatably outside the outer contact and is limited axially at the left end by the outer contact, the push nut surrounds outside the cable connector body and is limited axially at the right end by the cable connector body, the elastic component is located between the elastic claw and the push nut and props against the elastic claw and the push nut respectively, the coupling nut surrounds outside the elastic claw and is connected fixedly with the push nut, the convex teeth are within the declining slots respectively, and the second protruding part is located at the left side of the first protruding part.

In a further aspect, the elastic component is a spring.

In a further aspect, the outer contact and the cable connector body are connected in interference press-fit connection.

In a further aspect, the coupling nut and the push nut are connected in interference press-fit connection.

In a further aspect, the elastic claw props against the coupling nut.

In a further aspect, the number of the convex teeth is 6, the number of the declining slots is 6, or the number of the convex teeth is 10, and the number of the declining slots is 10. For SMA, preferably, the number of the convex teeth is 6, and the number of the declining slots is 6; for N and TNC, preferably, the number of the convex teeth is 10, and the number of the declining slots is 10.

In a further aspect, the elastic claw comprises a base and several spring fingers extending from the base, the declining slots are located between two of the spring fingers respectively, the second protruding part and the thread are provided on the outer side and the inner side of the spring fingers respectively, the base surrounds rotatably outside the outer contact and is limited axially at the left end by the outer contact, the elastic component is located between the base and the push nut and props against the base and the push nut respectively.

The beneficial effects of the present invention are as follows: the quick self-locking thread coupling interface connector mechanism of the present invention comprises an inner contact, an insulator, an outer contact, an elastic claw, a cable connector body, an elastic component, a coupling nut and a push nut, the inner contact is inside the insulator, the insulator is inside the outer contact, the coupling nut has at least one convex tooth and a first protruding part on the inner side, the elastic claw has declining slots whose number is same to that of the convex teeth, a second protruding part and thread are provided on the outer side and the inner side of the elastic claw respectively, the outer contact and the cable connector body are connected fixedly, the elastic claw surrounds rotatably outside the outer contact and is limited axially at the left end by the outer contact, the push nut surrounds outside the cable connector body and is limited axially at the right end by the cable connector body, the elastic component is located between the elastic claw and the push nut and props against the elastic claw and the push nut respectively, the coupling nut surrounds outside the elastic claw and is connected fixedly with the push nut, the convex teeth are within the declining slots respectively, and the second protruding part is located at the left side of the first protruding part, thus when the connecting end having thread of the female connector is inserted into the elastic claw until it props against the inner contact, the insulator and the outer contact, the push nut is pushed towards the left direction (to the direction of the female connector), so as to compress the elastic component, and push the coupling nut at the same time, by the convex teeth acting on the declining slots, the elastic claw is rotated, and the first protruding part of the coupling nut is forced to pass over and compress tightly the second protruding part on the outer side of the elastic claw to be self-locking, to make the elastic claw close to the outer thread of the connecting end gradually, until the mating point of the threads of the elastic claw and the connecting end is found and they are engaged completely, then the coupling nut is rotated, to rotate the elastic claw by the convex teeth on the inner side of the coupling nut acting on the declining slots, so as to rotate the elastic claw tightly on the female connector, and it only needs less than semicircle, for example about ¼ circle, to rotate the elastic claw tightly on the female connector, during this process, the first protruding part of the coupling nut passes over the second protruding part on the outer side of the elastic claw, for the elastic claw expands to return to its original position, the second protruding part is higher than the first protruding part, so that the coupling nut having the first protruding part is limited at the left side of the elastic claw and can not move to the right direction, so as to achieve the aims of compressing tightly, being self-locking, shockproof and preventing loose. When disassembled, the coupling nut is pulled to the left direction, so that the first protruding part presses down and passes over the second protruding part, the elastic claw expands to return to its original position to open, therefore the elastic claw releases and unlocks the thread on the connecting end of the female connector, at the same time the coupling nut is rotated reversely the corresponding circle number, for example about ¼ circle, then moved to the right direction to return to its original position by the elastic force of the elastic component, thus the male and female connectors can be separated, so the present invention is designed skillfully, has a concise structure, maintains the merits of the traditional coupling mechanism, applies to the thread connecting ends of the existing female connectors, and has the characteristics of connecting quickly and easily, broad application scope, easy to promote and low use cost, therefore the present invention is suitable for large-scale popularization.

DETAILED DESCRIPTION OF THE PREFERRED EMBODIMENT

Figure 1:
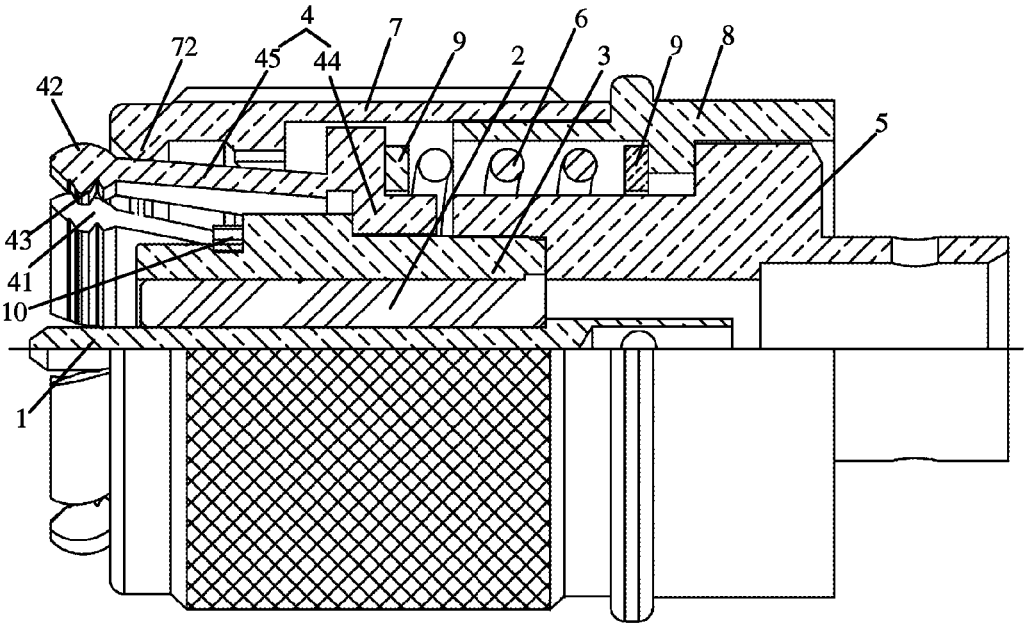
FIG. 1 is a schematic partial cutaway view of the front view of one embodiment of the present invention.

In order to understand the technical content of the present invention clearly, the present invention is further exemplified by reference to the following examples. Wherein the same component adopts the same reference sign.

Please refer to FIG. 1-4, the quick self-locking thread coupling interface connector mechanism of the present invention comprises an inner contact 1, an insulator 2, an outer contact 3, an elastic claw 4, a cable connector body 5, an elastic component 6, a coupling nut 7 and a push nut 8, the inner contact 1 is inside the insulator 2, the insulator 2 is inside the outer contact 3, the coupling nut 7 has at least one convex tooth 71 and a first protruding part 72 on the inner side, the elastic claw 4 has declining slots 41 whose number is same to that of the convex teeth 71, a second protruding part 42 and thread 43 are provided on the outer side and the inner side of the elastic claw 4 respectively, the outer contact 3 and the cable connector body 5 are connected fixedly, the elastic claw 4 surrounds rotatably outside the outer contact 3 and is limited axially at the left end by the outer contact 3, the push nut 8 surrounds outside the cable connector body 5 and is limited axially at the right end by the cable connector body 5, the elastic component 6 is located between the elastic claw 4 and the push nut 8 and props against the elastic claw 4 and the push nut 8 respectively, the coupling nut 7 surrounds outside the elastic claw 4 and is connected fixedly with the push nut 8, the convex teeth 71 are within the declining slots 41 respectively, and the second protruding part 42 is located at the left side of the first protruding part 72.

Figure 4:
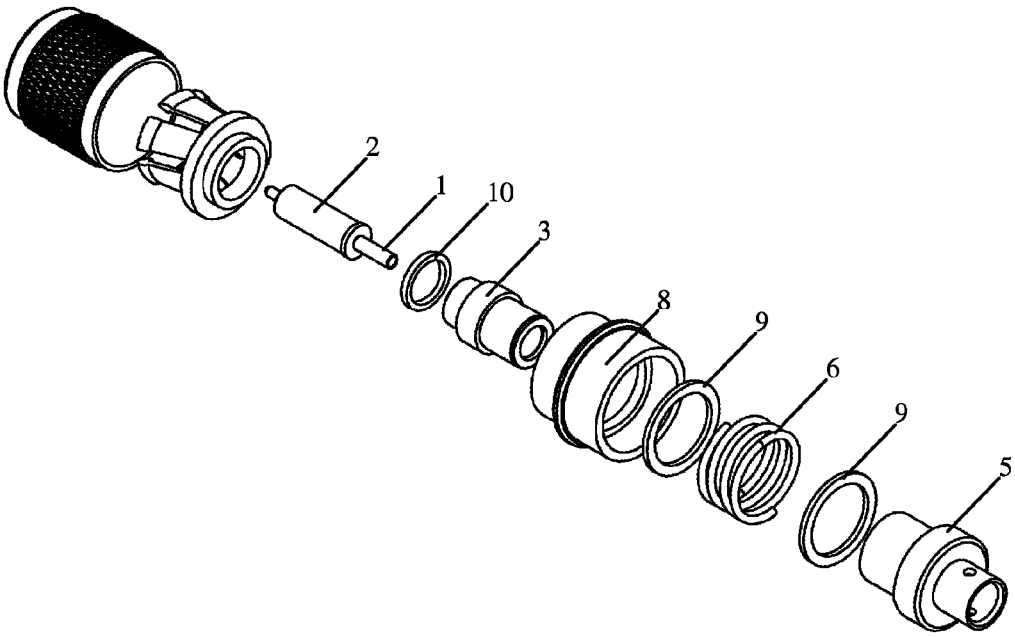
FIG. 4 is a schematic assembling view of the three-dimensional view of the embodiment shown in FIG. 1.

The elastic component 6 can adopt any suitable elastic component, please refer to FIG. 1 and FIG. 4, in one embodiment of the present invention, the elastic component 6 is a spring. And in order to operate more smoothly, washers 9 are provided at both ends of the spring respectively.

The outer contact 3 and the cable connector body 5 can be connected in any suitable manner, please refer to FIG. 1, in one embodiment of the present invention, the outer contact 3 and the cable connector body 5 are connected in interference press-fit connection.

The coupling nut 7 and the push nut 8 can be connected in any suitable manner, please refer to FIG. 1, in one embodiment of the present invention, the coupling nut 7 and the push nut 8 are connected in interference press-fit connection.

The elastic claw 4 can prop against the coupling nut 7, and also can not prop against the coupling nut 7, please refer to FIG. 1, in one embodiment of the present invention, the elastic claw 4 props against the coupling nut 7.

Figure 2:
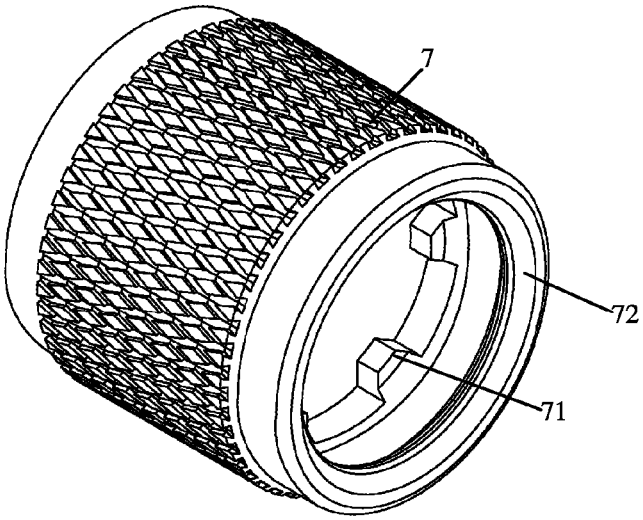
FIG. 2 is a schematic three-dimensional view of the elastic claw of the embodiment shown in FIG. 1.
Figure 3:
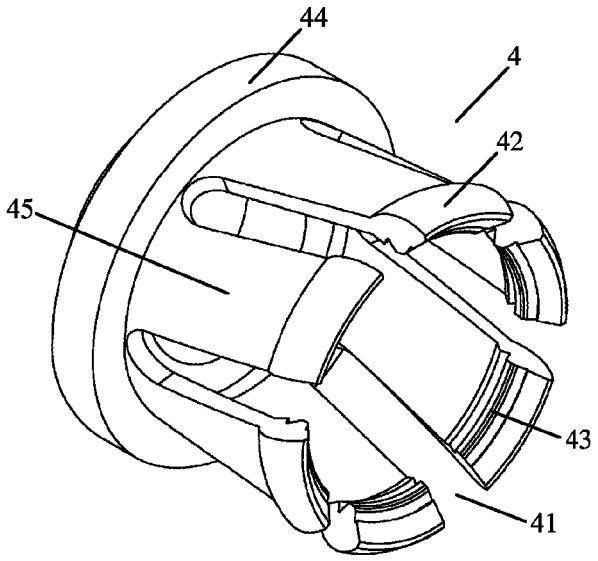
FIG. 3 is a schematic three-dimensional view of the coupling nut of the embodiment shown in FIG. 1.

The numbers of the convex teeth 71 and the declining slots 41 can be determined according to the requirement, please refer to FIG. 2-3, in one embodiment of the present invention, the number of the convex teeth 71 is 6, the number of the declining slots 41 is 6. This is relatively suitable for the SMA interface, for N and TNC interfaces, preferably, the number of the convex teeth 71 is 10, and the number of the declining slots 41 is 10.

The elastic claw 4 can have any suitable structure, and must be made with high-performance elastic materials such as beryllium copper and high-performance spring steel, stainless steel and so on. Please refer to FIGS. 1, 3 and 4 for the detailed structure, in one embodiment of the present invention, the elastic claw 4 comprises a base 44 and several spring fingers 45 extending from the base 44, the declining slots 41 are located between two of the spring fingers 45 respectively, the second protruding part 42 and the thread 43 are provided on the outer side and the inner side of the spring fingers 45 respectively, the base 44 surrounds rotatably outside the outer contact 3 and is limited axially at the left end by the outer contact 3, the elastic component 6 is located between the base 44 and the push nut 8 and props against the base 44 and the push nut 8 respectively. In particular, the spring fingers 45 prop against the coupling nut 7.

In order to ensure that the connection reaches the waterproof grade IP68, please refer to FIGS. 1 and 4, in one embodiment of the present invention, the waterproof gasket 10 meeting the SMA standard is retained on the outer contact 3. The waterproof gasket 10 surrounds around the outer side of the left end of the outer contact 3, and is located inside the elastic claw 4.

Figure 5:
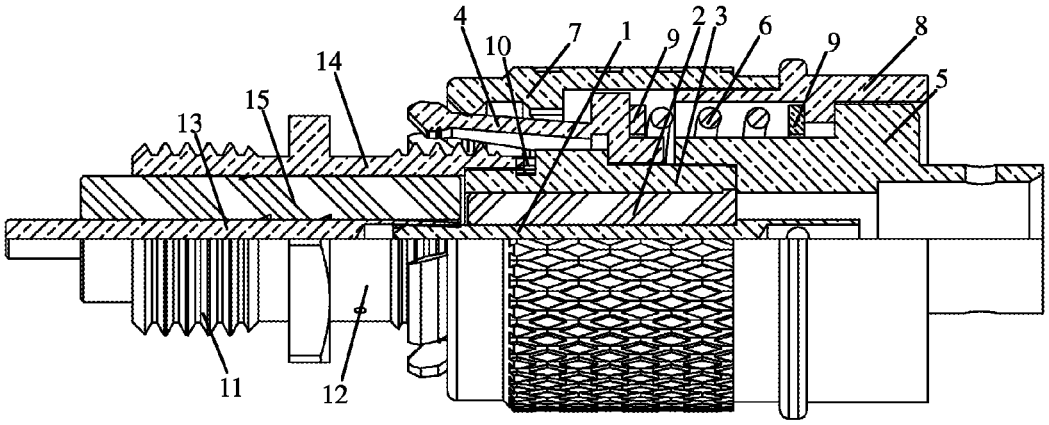
FIG. 5 is a schematic partial cutaway view of the front view of the embodiment shown in FIG. 1 and the connecting end of the female connector before connected.
Figure 6:
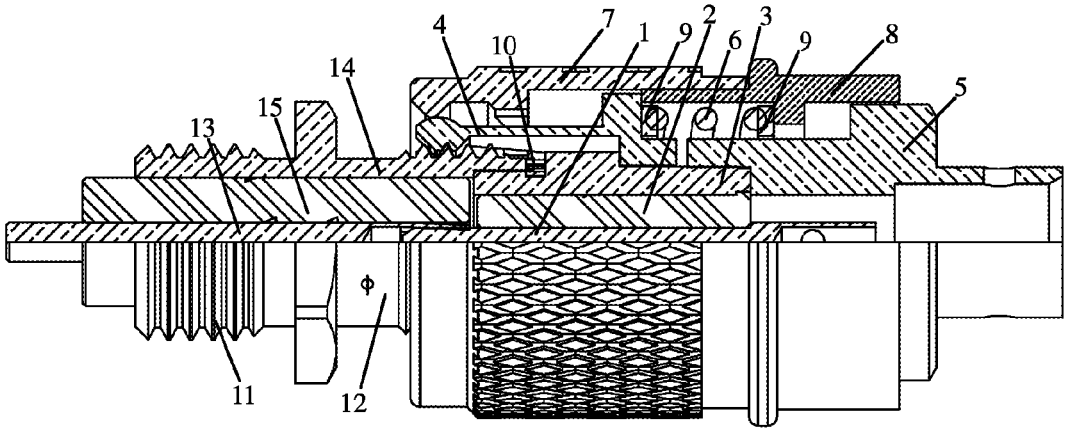
FIG. 6 is a schematic partial cutaway view of the front view of the embodiment shown in FIG. 1 and the connecting end of the female connector after connected.

When used, one coaxial cable (not shown) is inserted into and connected with the cable connector body 5 of the quick self-locking thread coupling interface connector mechanism of the present invention, the inner conductor of the coaxial cable contacts the inner contact 1 of the quick self-locking thread coupling interface connector mechanism of the present invention, the outer conductor of the coaxial cable contacts the cable connector body 5 of the quick self-locking thread coupling interface connector mechanism of the present invention. Please refer to FIG. 5, when the present invention is connected with the connecting end 12 with thread of the female connector 11 that another coaxial cable is inserted into and connected with, the elastic claw 4 is in the open state at this time, the connecting end 12 with thread of the female connector 11 is inserted into the elastic claw 4, at this time, the inner conductor 13 of the female connector 11 contacts the inner contact 1, the outer conductor 14 of the female connector 11 surrounds around the outer contact 3 and its end props against the outer contact 3 through the waterproof gasket 10, a gap less than 0.25 mm regulated by the SMA is existed between the insulating layer 15 of the female connector 11 between the inner conductor 13 and the outer conductor 14 and the insulator 2, the push nut 8 is pushed towards the left direction (to the direction of the female connector 11), so as to compress the spring, and push the coupling nut 7 at the same time, by the convex teeth 71 acting on the declining slots 41, the elastic claw 4 is rotated, and the first protruding part 72 of the coupling nut 7 is forced to pass over and compress tightly the second protruding part 42 on the outer side of the elastic claw 4 to be self-locking, to make the elastic claw 4 close to the outer thread of the connecting end 12 gradually, until the mating point of the thread 43 of the elastic claw 4 and the outer thread of the connecting end 12 is found and they are engaged completely, during this process, the vertex of the first protruding part 72 on the inner side of the coupling nut 7 moves from the right side of the vertex of the second protruding part 42 on the outer side of the elastic claw 4 to the left side of the vertex of the second protruding part 42 on the outer side of the elastic claw 4, for the elastic claw 4 expands to return to its original position, the second protruding part 42 is higher than the first protruding part 72, so that the coupling nut 7 having the first protruding part 72 is limited at the left side of the elastic claw 4 and can not move to the right direction, so as to achieve the aims of compressing tightly, being self-locking, shockproof and preventing loose. Then the coupling nut 7 is rotated, to rotate the elastic claw 4 by the six convex teeth 71 on the inner side of the coupling nut 7 acting on the declining slots 41, so as to rotate the elastic claw 4 tightly on the female connector 11, and it only needs less than semicircle, for example about ¼ circle, finally, as shown in FIG. 6, wherein the elastic claw 4 is in the close state. When disassembled, the coupling nut 7 is pulled to the left direction, so that the first protruding part 72 presses down and passes over the second protruding part 42, the elastic claw 4 expands to return to its original position to open, therefore the elastic claw 4 releases and unlocks the thread on the connecting end 12 of the female connector 11, at the same time the coupling nut 7 is rotated reversely the corresponding circle number, for example about ¼ circle, then moved to the right direction to return to its original position by the elastic force of the spring, thus the present invention and the female connector 11 can be separated, the elastic claw 4 is in the open state again. For the existing standard thread-coupling connection, it would take a lot of time in the beginning mating, and need rotating 4-5 circles to achieve stable connection, therefore the installation and the removal both are very cumbersome.

The quick self-locking thread coupling interface connector mechanism of the present invention addresses the issues existed in the existing thread coupling mechanism while maintains the merits of traditional coupling mechanism, can quick mate with the standard female connector; the quick self-locking thread coupling interface connector mechanism of the present invention has the elastic claw 4 which has standard thread, the coupling nut 7 and the elastic component 6 as a novel coupling mechanism to be self-locking and easy locking release. The present invention could be a different approach comparing with QLF QMA/QN structure that is widely accepted by the industry. This new invention could be quick adapted to various common interface types, like SMA, TNC, N and so on, without any change in female connector, often used in the cabinet, the antenna feedback systems, and the base station antennas, and can be used in communication equipments, test and measurement, medical equipments. Compared with the SNAP-N interface which needs a special female structure to connect with, the present invention has a broader application scope and a lower cost.

To sum up, the quick self-locking thread coupling interface connector mechanism of the present invention is designed skillfully, has a concise structure, maintains the merits of the traditional coupling mechanism, applies to the thread connecting ends of the existing female connectors, and has the characteristics of connecting quickly and easily, broad application scope, easy to promote and low use cost, therefore the present invention is suitable for large-scale popularization.

In the present specification, the present invention has been described according to the particular embodiments. But it is obvious that these embodiments can be modified or changed without departure from the spirit and scope of the present invention. Therefore, the specification and drawings described above are exemplary only and not intended to be limiting.

We claim:

1. A quick self-locking thread coupling interface connector mechanism, comprising an inner contact, an insulator and an outer contact, the inner contact being inside the insulator, the insulator being inside the outer contact, characterized in that, the quick self-locking thread coupling interface connector mechanism further comprises an elastic claw, a cable connector body, an elastic component, a coupling nut and a push nut, the coupling nut has at least one convex tooth and a first protruding part on the inner side, the elastic claw has declining slots whose number is same to that of the convex teeth, a second protruding part and thread are provided on the outer side and the inner side of the elastic claw respectively, the outer contact and the cable connector body are connected fixedly, the elastic claw surrounds rotatably outside the outer contact and is limited axially at the left end by the outer contact, the push nut surrounds outside the cable connector body and is limited axially at the right end by the cable connector body, the elastic component is located between the elastic claw and the push nut and props against the elastic claw and the push nut respectively, the coupling nut surrounds outside the elastic claw and is connected fixedly with the push nut, the convex teeth are within the declining slots respectively, and the second protruding part is located at the left side of the first protruding part;

wherein travel of the convex teeth within the declining slots during rotation of the coupling nut rotates the elastic claw around the cable connector body at a greater rotation rate than the coupling nut.

2. The quick self-locking thread coupling interface connector mechanism according to claim 1, wherein the elastic component is a spring.

3. The quick self-locking thread coupling interface connector mechanism according to claim 1, wherein the outer contact and the cable connector body are connected in interference press-fit connection.

4. The quick self-locking thread coupling interface connector mechanism according to claim 1, wherein the coupling nut and the push nut are connected in interference press-fit connection.

5. The quick self-locking thread coupling interface connector mechanism according to claim 1, wherein the elastic claw props against the coupling nut.

6. The quick self-locking thread coupling interface connector mechanism according to claim 1, wherein the number of the convex teeth is 6, the number of the declining slots is 6, or the number of the convex teeth is 10, and the number of the declining slots is 10.

7. The quick self-locking thread coupling interface connector mechanism according to claim 1, wherein the elastic claw comprises a base and several spring fingers extending from the base, the declining slots are located between two of the spring fingers respectively, the second protruding part and the thread are provided on the outer side and the inner side of the spring fingers respectively, the base surrounds rotatably outside the outer contact and is limited axially at the left end by the outer contact, the elastic component is located between the base and the push nut and props against the base and the push nut respectively.

* * * * *